US005774896A

United States Patent [19]

Hochmuth

[11] Patent Number: 5,774,896

[45] Date of Patent: Jul. 7, 1998

[54] GOALKEEPER'S GLOVE WITH IMPROVED FINGER FIT

[76] Inventor: Peter Hochmuth, Weissenburger Str. 19, D-91757 Treuchtlingen, Germany

[21] Appl. No.: 740,357

[22] Filed: Oct. 28, 1996

[30] Foreign Application Priority Data

Oct. 27, 1995 [DE] Germany ..... 295 17 050 U

[51] Int. Cl.[6] ..... A41D 19/00

[52] U.S. Cl. ..... 2/161.1; 2/159

[58] Field of Search ..... 2/159, 161.1, 161.6, 2/161.7, 164, 167, 169, 168, 162, 163

[56] References Cited

U.S. PATENT DOCUMENTS 5,136,725 8/1992 Montero ..... 2/161.1

FOREIGN PATENT DOCUMENTS 2281020 2/1995 United Kingdom ..... 2/161.1

*Primary Examiner*—Gloria Hale

*Attorney, Agent, or Firm*—Anderson Kill & Olick, P.C.

[57] ABSTRACT

A goalkeeper's glove having upper and inner portions each with a hand region, four front finger regions, and a wrist region, separation areas provided between adjacent finger regions of the upper and inner portions, and elongate side strips and elongate layer strips connecting the upper and inner portions, with the lateral edges of the strips of the upper portion being turned inward into the finger regions, and with the separation areas between finger regions of the inner portion being formed as slits.

4 Claims, 1 Drawing Sheet

GOALKEEPER'S GLOVE WITH IMPROVED FINGER FIT

BACKGROUND OF THE INVENTION

1. Field of the Invention

The present invention relates to a goalkeeper's glove including upper and inner portions having each a hand region, four front finger regions, and a wrist region, separation areas provided between adjacent finger regions of the upper and inner portions, and elongate side strips and elongate layer strips connecting the upper and inner portions, with the side and layer strips being applied to both upper and inner portions, sewed thereto, and forming lateral edges extending parallel to respective seams.

2. Description of the Prior Art

German Publication No. 4,140,514 discloses a goalkeeper's glove of the above-described type, in which the lateral edges of the side and layer strips are turned upward and extend adjacent to the lateral edges of the finger regions. The separation areas between the finger regions of the inner portion in the goalkeeper's glove disclosed in this German publication are formed as severance cuts, so that two adjacent finger regions contact each other along a severance cut. Therefore, the goalkeeper has often a feeling as if the glove is too wide or that the finger regions do not satisfactorily fit the fingers of the hand.

Accordingly, an object of the present invention is a goalkeeper's glove of the above-described type in which the finger regions of the glove would fit the hand fingers much better than the known glove.

SUMMARY OF THE INVENTION

This and other objects of the present invention, which will become apparent hereinafter, are achieved by turning the lateral edges of the side and layer strips, which are associated with the upper portion, inward and folding them into respective finger regions, and by forming the separation areas between two adjacent finger regions of the inner portion as slits.

By turning the lateral edges formed on the upper glove portion inward, the inner cross-section of the glove fingers is increased. This increase is compensated by reducing, from both sides, the width of the finger regions of the inner glove portion. The two measures together provide for a better fit and a feeling that the finger regions better envelope the hand fingers, which increases the reliability of a ball grip by the goalkeeper. The width of the separation slits generally amounts to about 11–21% of the width of the smallest finger region of the inner glove portion.

It is particularly advantageous when the slits have the same width along their entire length. This insures a good fit along the entire finger regions.

Generally, in a goalkeeper's glove of this type, the hand region and the finger regions of the upper portion are provided with a protective coating or some other protective layer, and the hand region and the finger regions of the inner portion are provided with a latex coating. Both wrist regions are provided with narrowing means, which permit to adjust the circumference of the wrist region to adapt it to a wearer. Such means may be formed as a separation slot bridged with some kind of an overlap strip, such as Velcro™ strip. The separation areas between the finger regions of the upper glove portion are formed either as separation cuts or as wedge-shaped slits, the peaks of which lie in the hand region.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENT

Figure 1:
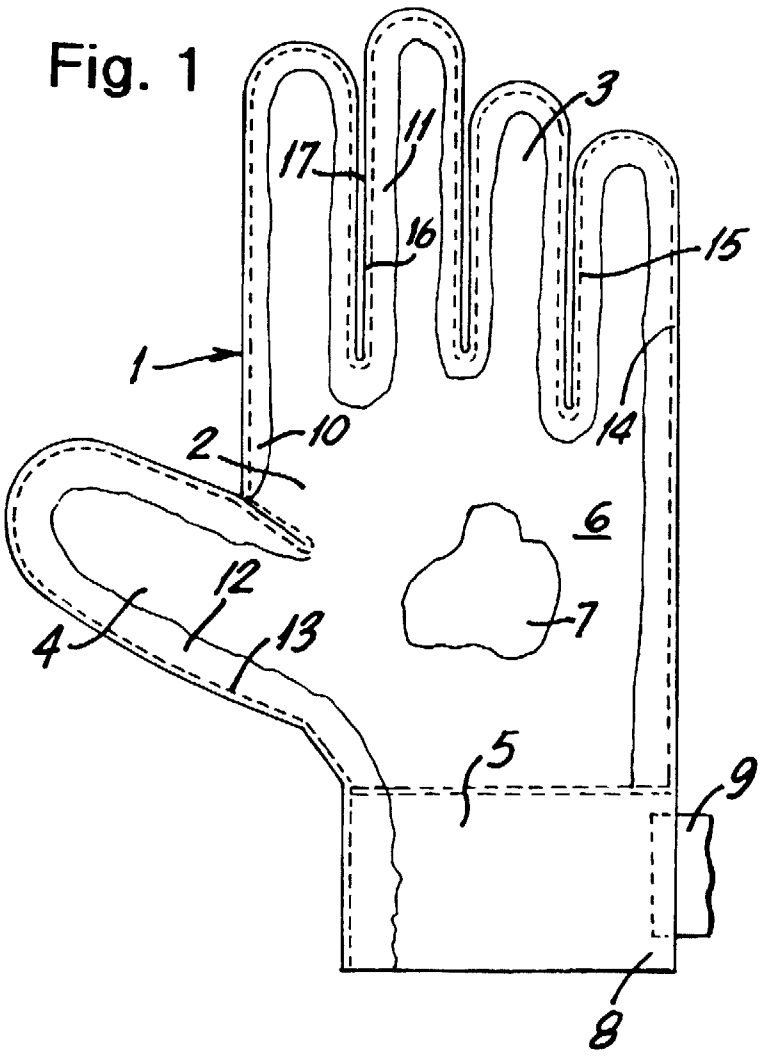
FIG. 1 is a plan view of the inner side of a goalkeeper's glove according to the present invention.
Figure 2:
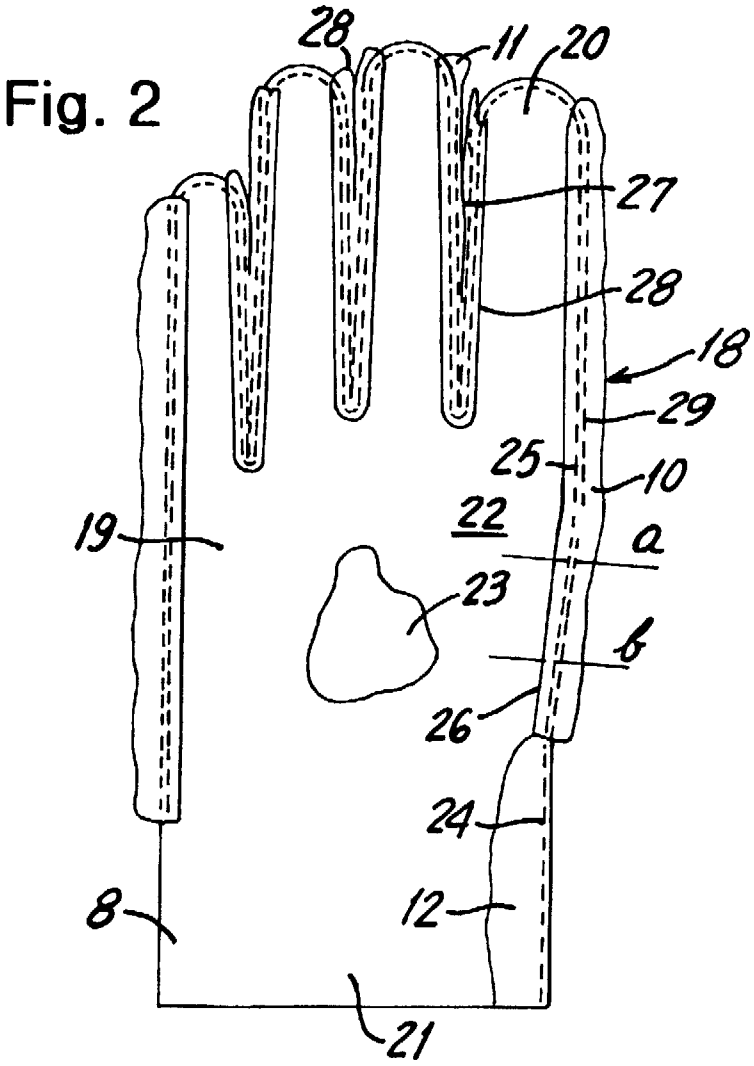
FIG. 2 is a plan view of the upper side of the goalkeeper's glove according to the present invention.

The goalkeeper's glove according to the present invention, which is shown in the drawings, has an inner portion 1 including, formed integrally with each other, a hand region 2, four front finger regions 3, a thumb region 4, and a wrist region 5. The inner portion of the glove further includes a support layer 6 and an outer latex coating 7. The wrist region 5 has, on a side thereof opposite the thumb region 4, a separation slot 8 which can be bridged with a strap of a Velcro™ clasp 9. Two elongate side strips 10, seven elongate layer strips 11, and a thumb strip 12 are sewed on the inner portion with seams 13, 14 and 15. The lateral edges 16 of the side strips 10, layer strips 11, and the thumb strip 12 are turned outward and, therefore, the seams 13, 14 and 15 are clearly visible. Separation slits 17 are provided between the finger regions 3. The slits 17 have substantially the same width along their entire length.

The upper portion 18 has a hand region 19, four finger regions 20 and a wrist region 21. The upper side also includes a support layer 22 and a coating 23 formed on a support layer 22. The wrist region 21 limits, at one side thereof, the separation slot 8 and, at the opposite side thereof, is sewed to the thumb strip 12 with a seam 24. The lateral edge of the thumb strip 12 faces upward. The two elongate side strips 10 are sewed to respective finger regions 20 and the hand region 19 with a seam 25, with their lateral edges 26 being turned inward, so that the seam 25 is not visible from outside at that, the seam 25 is so arranged that the distance a between a respective seam 25 and an edge 29 of a respective finger region 20 is smaller than the distance b between the seam 25 and the lateral edge 26 of the side strip 10. The layer strips 11 are sewed to respective finger regions 20 with a seam 27, likewise with their lateral edges being turned inward, so that the seam 27 is also not visible from outside. In this case likewise, the distance between the seam 27 and the lateral edge of the layer strip 11 exceeds the distance between the seam 27 and the lateral edge 29 of a respective finger region. The foregoing arrangement of the seams 25 and 27 substantially improves firmness of the seam connections. Separation slits 28 are provided between the finger regions 20. The slits 28 are substantially wedge-shaped along their longitudinal extent.

While the present invention was shown and described with reference to a preferred embodiment, various modifications thereof will be apparent to those skilled in the art and, therfore, it is not intended that the invention be limited to the disclosed embodiment or details thereof, and departure can be made therefrom within the spirit and scope of the appended claims.

What is claimed is:

1. A goalkeeper's glove, comprising:

upper and inner portions having each a hand region, four front finger regions, and a wrist region;

separation areas provided between adjacent finger regions of the upper and inner portions, and elongate side strips and elongate layer strips connecting the upper and inner portions;

wherein the side and layer strips are applied to both upper and inner portions, are sewed thereto, and form lateral edges extending parallel to respective seams, wherein lateral edges of the side and layer strips, which are associated with the upper portion are being turned inward and are folded into respective finger regions, and wherein the separation areas between two adjacent finger regions of the inner portion are formed as slits.

2. A goalkeeper's glove as set forth in claim 1, wherein the slits have substantially the same width along a substantially entire length thereof.

3. A goalkeeper's glove as set forth in claim 1, wherein a distance between a seam, with which a respective side strip is sewn to the upper portion, and a lateral edge of the respective side strip is bigger than a distance between the seam and a lateral edge of a respective finger region.

4. A goalkeeper's glove as set forth in claim 1, wherein a distance between a seam, with which a respective layer strip is sewn to the upper portion, and a lateral edge of the respective layer strip is bigger than a distance between the seam and a lateral edge of a respective finger region.

* * * * *